United States Patent [19]

Fahringer

[11] Patent Number: 4,923,161

[45] **Date of Patent: * May 8, 1990**

[54] DEVICE FOR COUPLING HOOKS TO PEGBOARD

[76] Inventor: Thomas L. Fahringer, 105 Locust Dr., Brandon, Fla. 33511

[ * ] Notice: The portion of the term of this patent subsequent to Jan. 24, 2006 has been disclaimed.

[21] Appl. No.: 294,203

[22] Filed: Jan. 6, 1989

Related U.S. Application Data

[63] Continuation of Ser. No. 71,166, Jul. 8, 1987, Pat. No. 4,799,637.

[51] Int. Cl.[5] ..... E04G 5/06

[52] U.S. Cl. ..... 248/221.2; 248/316.7; 411/400

[58] Field of Search ..... 248/221.2, 221.3, 222.2, 248/316.7, 220.3, 220.4, 221.4; 411/400, 401, 386, 509, 510, 512, 907

[56] References Cited

U.S. PATENT DOCUMENTS

| | | | |
|---|---|---|---|
| 1,260,154 | 3/1918 | Day | 411/386 |
| 2,790,616 | 4/1957 | Cardinal, Jr. | 248/221.2 |
| 2,859,008 | 11/1958 | Zimmer | 248/221.2 |
| 3,296,048 | 1/1967 | Wolfe | 411/907 X |
| 3,625,464 | 12/1971 | Conran | 248/221.2 |
| 3,664,625 | 5/1972 | Price | 248/221.2 |
| 3,879,006 | 4/1975 | Staudte, Jr. | 248/221.2 |
| 4,304,382 | 12/1981 | Jelen | 248/221.4 X |
| 4,799,637 | 1/1989 | Fahringer | 411/400 X |

*Primary Examiner*—Ramon O. Ramirez

*Attorney, Agent, or Firm*—Dominik, Stein, Saccocio, Reese, Colitz & Van Der Wall

[57] ABSTRACT

An attachment device for use in combination with a pegboard and a hook. The device includes a screw constituting the inboard end of the device. The screw is of such configuration that, upon being twisted into a pegboard hole, it may be positively held by forces exerted by the surfaces of the screw on opposite sides of the pegboard at the peripheries of the hole without deforming the hole. The device also includes a clip constituting the outboard end of the device and coupled to the screw for being positively fastened to the pegboard by the screw. The clip is formed of a pair of symetrically shaped, resilient support arms which together form an opening which will allow movement of the central portion of a hook therepast only upon the separating of the arms which thereby facilitates the receipt and releasable retention of a hook by the resilient force of the arms so that the device may effect a permanent attachment of a hook to a pegboard until the hook is physically withdrawn from the clip by overcoming the resilient retention force of the arms retaining the hook.

1 Claim, 1 Drawing Sheet

DEVICE FOR COUPLING HOOKS TO PEGBOARD

This is a continuation of co-pending application Ser. No. 07/071,166 filed on July 8, 1987, now U.S. Pat. No. 4,799,637.

BACKGROUND OF THE INVENTION

1. Field of the Invention

This invention relates to the coupling of hooks to pegboard and, more particularly, to a device having, at one end, a screw for positively fastening to the hole of pegboard and having, at the other end, a resilient clip for releasably retaining a portion of a hook.

2. Description of the Background Art

For many years it had been a common practice of people to store individual tools and like articles on hooks firmly screwed into the wall of a workroom, garage, basement or other convenient area. The stored tools would thereby be individually located in plain sight for being conveniently found, used, and then returned to their preassigned locations as determined by the user. When, however, certain tools were lost, broken or replaced with different models, or if additional tools were acquired, it would become necessary to unscrew the wall hooks and reinstall them at new and more convenient locations so as to accommodate the new tool to be stored. Unfortunately, such a system of tool storage would result in unsightly screw holes in the wall following each repositioning of wall hooks. Unsightly holes or repeated hole patching were the price to be paid for the convenience of tools stored on firmly positioned hooks.

In recent years, a product known as pegboard has eliminated the need for the repeated repositioning of screws with their hooks into the wall of a tool storage area. Pegboard is a sheet of composition material having characteristics similar to wood. Pegboard is formed with holes of a common diameter extending therethrough and arranged in rows and columns. Used in association with pegboard are hooks removably positionable in the holes. The hooks have a lower portion outwardly bent away from the pegboard for supporting an article to be stored, an upper portion inwardly bent toward the pegboard for being positioned through a hole in the pegboard, and an elongated central portion coupling the upper and lower portions. Although the hooks are quickly and easily repositionable on the pegboard for rearranging the user's tools, the pegboard itself is normally positioned on a wall permanently by screws, through spacers so as to allow the upper portion of each hook to extend therethrough.

As can be readly appreciated, the use of pegboard and hooks eliminates the disadvantages of repositioning hooks screwed into walls as occurred with the previous practice. The popularity of pegboard can thus be easily understood. But as happens with the development of new and improved products, there are often associated new and unexpected disadvantages. In the case of pegboard, the chief disadvantage is in the nature of the securement of the pegs to the pegboard. When, for example, a tool is removed from its supporting hook on a pegboard, the hook will frequently be pulled along with the tool and inadvertantly dropped from the pegboard. This requires the user to find the fallen hook, pick it up and reposition it in its prior location, if such prior location can be recalled. This inconvenience may be overcome by the more careful removing of tools and constitutes only a minor inconvenience when compared with the inconvenience of plastering holes as with the earlier practice. But the inconvenience is, in fact, real and has lead many people to seek a solution to the problem of more securely coupling hooks to pegboard. Inadvertant removal of hooks is the price to be paid for the inconvenience of the easy repositioning of hooks.

The optimum system would be something new which combines the benefits of the prior practices without their shortcomings, i.e., securely positioned hooks which could be readily repositioned by a user without the inconvenience of holes in the wall after the repositioning. Such an optimum system would preferably provide the known benefits, avoiding known shortcomings, not by a totally new system, but by the simple addition of an inexpensive device to existing pegboard-hook systems.

The patent literature documents the dissatisfaction of many people with known pegboard-hook systems as well as their efforts to devise the optimum system. Consider, for example, U.S. Pat. No. 2,961,724 to Alling and Canadian Patent No. 1049478 to Marleau. These patents describe attachment devices for coupling hooks to pegboard. Conventional hooks are employed but require supplemental special devices to improve the securement of the hooks to the pegboard. According to these disclosures, the devices frictionally attach within pegboard holes whereby the force lifting a tool from a hook may very well withdraw the device from the hole with the same undesirable results as if no device were used at all. In addition when devices relying on frictional, nonpositive, securement forces are used between hook parts and pegboard holes, there is a continuous abrasion of the hole each time the device is inserted into, or withdrawn from, the hole. As a result if the hole were to be abandoned and then later reused, it would be enlarged rendering it less suitable for its intended purpose.

The patents to Cardinal, Terlinde and Conran, U.S. Pat. Nos. 2,790,616; 3,227,412 and 3,625,464 describe systems which function without special additional devices as discussed above. They do require, however, specially designed hooks with additional insertion fingers. This presents the many current owners with the expense of replacing their present hooks with the more expensive ones as described in these patents. In addition, the interference or frictional fit of the additional insertion fingers of the new hooks extending into the holes causes the undesirable hole widening abrasion as described above with regard to the use of supplemental frictional attachment devices.

The majority of the prior patents directed to the improved coupling of hooks and pegboard employ special hooks in addition to supplemental attachment devices. Note U.S. Pat. No. 3,037,733 to Roman; 3,091,423 to Butterworth; 3,289,991 to Kalahar; 4,105,179 to Elliott and 4,531,697 to Steiner. These patents combine the negative aspects of high cost and hole abrasion without attaining the full benefits as intended.

Lastly, other related devices might be considered pertinent as techniques for coupling members to holes in a board. Consider, for example, U.S. Pat. No. 3,067,536 to Brittsan wherein the member to be coupled specifically enlarges its supporting hole through a broaching action to effect an intended coupling. Hole enlargement must, however, be avoided in hook-pegboard systems where hole reuse is desired.

As illustrated by the great number of prior patents as well as commercial devices, efforts are continuously being made in an attempt to couple hooks to pegboard more efficiently, conveniently, reliably and economically. None of these previous efforts, however, provide the benefits attendant with the present invention. Additionally, prior techniques and apparatus do not suggest the present inventive combination of component elements arranged and configured as disclosed and claimed herein. The present invention achieves its intended purposes, objectives and advantages over the prior art devices through a new, useful and unobvious combination of component elements, with the use of a minimum number of functioning parts, at a negligible cost to manufacture, and by employing only readily available materials.

Therefore, it is an object of this invention to provide a hook to pegboard attachment device having, at one end, a screw for positively fastening to the hole of pegboard and having, at the other end, a resilient clip for releasably retaining a portion of a hook.

It is an additional object of the invention to positively fasten a device to pegboard for releasably securing a hook to the pegboard.

It is a further object of the invention to releasably secure a hook to the pegboard through a device positively fastened to the pegboard.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodment shown in the attached drawings. For the purpose of summarizing the invention, the invention comprises an attachment device for use in combination with a pegboard and a hook. The pegboard is of a predetermined thickness with holes of a predetermined diameter extending therethrough. The hook has a lower portion outwardly bent away from the pegboard for supporting articles, an upper portion inwardly bent toward the pegboard for being positioned through a hole in the pegboard, and an elongated central portion coupling the upper and lower portions. The attachment device includes a screw constituting the inboard end of the device and being fastenable within a hole in the pegboard. The size of the screw is correlated to the thickness of the pegboard and the diameter of the hole such that crests of the screw are of a diameter larger than the diameter of the hole and roots of the screw are of a diameter smaller than the diameter of the hole and with the surfaces of the screw which join the crests and roots being axially spaced a distance so that, upon being twisted into the hole, the screw may be positively held by forces exerted by the surfaces of the screw on opposite sides of the pegboard at the peripheries of the hole without deforming the hole. The attachment device also includes a clip constituting the outboard end of the device and coupled to the screw for being positively fastened to the pegboard by the screw. The clip is formed of a pair of symetrically shaped, resilient support arms which together form a generally semicircular cross sectional configuration in excess of 180 degrees with an opening between the arms on the side of the clip remote from the screw. The clip is of a size so that its opening will allow movement of the central portion of a hook therepast only upon the separating of the arms which thereby facilitates the receipt and releasable retention of a hook by the resilient force of the arms so that the device may effect a permanent attachment of a hook to a pegboard until the hook is physically withdrawn from the clip by overcoming the resilient retention force of the arms retaining the hook.

In addition, for the purpose of summarizing the invention, the invention also comprises, for use in combination with a pegboard and a hook, a coupling device including a fastener and a retention means. The fastener constitutes the inboard end of the device and is fastenable to a hole in the pegboard. The fastener is correlated in size to the pegboard and hole such that upon being fastened within the hole, it will be positively held by forces exerted by the fastener on the pegboard. The retention means constitutes the outboard end of the device and is coupled to the fastener for being positively fastenable to the pegboard by the fastener. The retention means is constructed for applying a releasable retention force to a portion of a hook whereby the device effects a permanent attachment of the hook to a pegboard until the hook is withdrawn from the retention means to overcome the force retaining the hook to the retention means. The fastener is positively held within the hole by forces exerted by the fastener on opposite sides of the pegboard. The fastener is a screw. The retention means is a clip formed of a pair of symetrically shaped, resilient support arms which together form an essentially semicircular cross sectional configuration in excess of 180 degrees with an opening between the arms on the side of the clip remote from the screw. The clip is of a size so that the opening will allow movement of the central portion of a hook therepast only upon the separating of the arms which thereby facilitates the receipt and removal of a central portion of the hook from the clip.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts through the several views of the drawings.

DETAILED DESCRIPTION OF THE PREFERRED EMBODIMENT OF THE INVENTION

Figures 1, 2, 3, 4, 5, 6, 7:
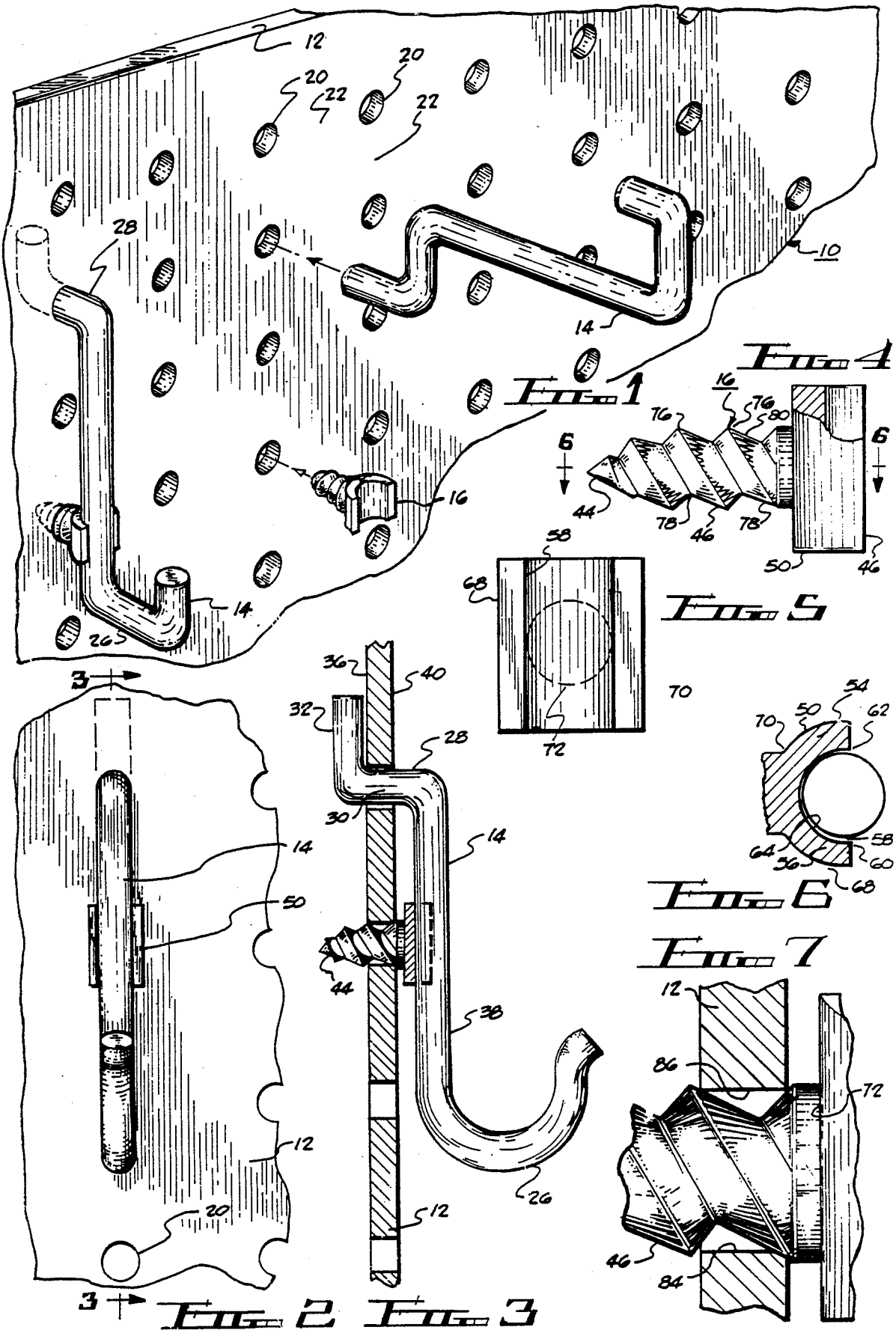
FIG. 1 is an isometric view of hooks, pegboard and attachment devices constructed in accordance with the primary embodiment of the present invention showing one hook and attachment device coupled to the pegboard and also showing another hook and attachment device in an exploded configuration.
FIG. 2 is a front view of a hook and attachment device coupled to pegboard as shown in FIG. 1.
FIG. 3 is a sectional view of the hook, attachment device and pegboard as shown in FIG. 2.
FIG. 4 is a side view of the hook shown in FIG. 1, 2 and 3.
FIG. 5 is a front view of the attachment device as shown in FIGS. 1, 2 and 3 including a portion of the hook in phanthom lines.
FIG. 6 is a side view of the attachment device as shown in FIGS. 1, 2 and 3 including a portion of the hook in phanthom lines.
FIG. 7 is an end view of the attachment device as shown in FIGS. 1, 2 and 3 including a portion of the hook in phanthom lines.

Shown in FIGS. 1, 2 and 3 is a combination 10 of pegboard 12, hook 14 and attachment device 16. The pegboard 12 and hook 14 are conventional items of commerce. One conventional type of hook also includes a horizontal projection welded or otherwise secured to the central vertical section and insertable in a pegboard hole. Such projection may easily be snapped off so the hook may be used in association with the present invention. The attachment device 16, described herein in its primary or preferred embodiment, is of a new structure and function and constitutes the subject matter of the present invention. The attachment device is of particular utility when used in association with pegboard and hooks, whether conventional or not.

Pegboard 12, such as that described herein, is a large, low cost sheet of composition material having characteristics similar to wood. In order to function in the supporting of hooks and tools, it is formed with holes 20 extending therethrough arranged in rows and columns. The holes 20 are all of a common, standard diameter and of a common, standard depth due the the general use of pegboard sheet material of a common, standard thickness. The spacing 22 between the holes, both horizontally and vertically, is sufficient to allow the coupling of a plurality of hooks to the pegboard. The number of hooks and tools to be used in association with any sheet of pegboard is dependent upon the size of the sheet. Larger or smaller sheets of pegboard may be utilized as a function of the area available upon which the pegboard is to be secured. Further, in some instances, two or more smaller pegboard sheets may be preferred to a single larger sheet. Pegboard is secured to the wall or other appropriate surface of a workroom, garage, basement or other convenient area as might be desired by the user. Attachment of pegboard to a wall is effected through long screws located through holes in the corners of the pegboard sheet. Cylindrical spacers, through which the screws pass, are preferably located between the wall and pegboard in order to retain the pegboard properly spaced from the wall. In this manner, hooks may pass through the pegboard holes to effect their coupling as will be described hereinafter.

Used in association with pegboard 12 are the hooks 14. Each hook 12 is a particularly configured, cylindrical, wire like member adapted to be removably positionable through the holes in the pegboard for supporting a tool or like article. Each hook has a lower portion 26 outwardly bent away from the pegboard for supporting an article to be stored. It also has an upper portion 28 with a horizontal, inwardly extending part 30 terminating in a vertical, upwardly extending part 32. The inwardly extending part 30 faces toward the pegboard for being positioned through a hole 20 so that its lowermost edge rests on the bottom of the hole to preclude the dropping of the hook from the pegboard. The upwardly extending part 32 is for for being positioned through the hole so that its innermost edge rests on the interior side 36 of the pegboard above the hole tending to preclude the pulling out of the hook from the pegboard. An elongated central portion 38 couples the upper and lower portions and normally rests against the exterior side 40 of the pegboard beneath the hole. Note in particular, the showings of FIGS. 1 through 4.

Referring to the views of FIGS. 1 through 3 and 5 through 7, there is shown an attachment device 16 used to couple the hook 14 to the pegboard 12. The attachment device has an inboard end 44 formed as as a fastener shown as a screw 46 for being positively fastened to pegboard by its passage through a hole without abrading or otherwise deforming the hole. At the outboard end 48, the attachment device is formed as a clip 50 adapted to releasably receive and retain a central portion of a hook. By this arrangement, a hook may by releasably coupled with a pegboard in a more secure manner than had been previously possible.

The clip 16 is formed of a pair of symetrically shaped support arms 54 and 56 formed of a spring steel or the like to provide them with resiliency. Together the arms form a generally semicircular cross sectional configuration. The interior diameter of the arms is substantially the same as the exterior diameter of the central portion of the hook it is to receive and releasably retain. The arms 54 and 56 generally extend to slightly in excess of 180 degrees for holding the hook and precluding its inadvertant movement away from the attachment device. Note FIG. 7. The arms of the clip form an opening 58 on the side of the clip remote from the screw. The clip is of a size so that its opening 58 will allow movement of the central portion 38 of a hook 16 therepast only upon the slight separating of the arms. This separating is normally effected by a user pushing the central portion of the hook against the free ends 60 and 62 of the arms. The movement of the hook toward the chamber 64 formed by the arms, in combination with the force of the hook against the free ends of the arms, facilitates the receipt and releasable retention of the hook by the resilient force of the arms with a snapping action. The device 16 may thus effect a permanent attachment of a hook to a pegboard until the hook is physically withdrawn from the clip by a user, past the free ends of the arms, by overcoming the resilient retention force of the arms holding the hook.

The clip is preferably formed of two symetrically shaped halves 68 and 70 as can be seen in FIG. 7. In the alternative, the clip could be formed as a one piece component. In either event, the inboard end of the clip, remote from the free ends of the arms, is preferably affixed at its inboard end to the outboard end of the screw. In a yet further embodiment, the entire attachment device, including clip and screw, could be fabricated as a one piece item. The fabrication could be done of any appropriate plastic or metal.

Although shown in several of the Figures, the screw and its operation may be best understood by referring to FIG. 3. The size of the screw is correlated to the thickness of the pegboard and the diameter of the hole, such thickness and diameter being common and conventional. Its crests 76 are of a diameter larger than the diameter of the hole. The roots 78 of the screw are of a diameter smaller than the diameter of the hole. The inclined surfaces 80 of the screw which join the crests and roots are axially spaced along the screw a distance so that, upon being twisted into the hole, the screw may be positively held by forces exerted by the inclined surfaces of the screw on opposite sides of the pegboard at the peripheries of the hole without deforming the hole.

Rotation of the screw advances the screw into the hole by the force of the lower leading inclined surface acting against the lower edge of the hole on the interior side of the pegboard. Continued rotation advances the screw until it is fully positioned for operation and use with its clip in contact with the pegboard. This position is shown in FIG. 3. It should be noted that the screw 46, and consequently the clip 50, is positively held with respect to the pegboard 12 by forces exerted by the inclined surfaces of the screw on opposite sides of the pegboard at the internal and external peripheries of the hole. This is a positive fastening, superior to the frictional, non-positive forces found in the securement of devices described in the prior attempts to couple hooks to pegboards. In addition, unlike frictional couplings, the hole is not deformed by the present holding action of the screw except for a single indentation on the interior surface of the hole which functions as a thread of a bolt.

With a clip 50 affixed to the outboard end of the screw 46, no tool is required to fasten or unfasten the attachment device to the pegboard. Unfastening the attachment device is as simple as its fastening, merely twist out the screw by rotating it in the opposite direction.

As can be seen in the Figures, the attachment device 16 is of a reduced size so that when operatively positioned in the pegboard 12 it will extend outwardly from its supporting hole 20 in a radial direction to a distance less than half the distance to any adjacent hole 20 on the pegboard 12. In this manner, such devices in a pegboard will not interfere with the use of any additional hole or holes in the pegboard for maximum utility of all the holes in the pegboard.

In operation and use, an attachment device 16 is first fastened to the pegboard at a location as desired by the user. This is accomplished by the user grasping the clip portion of the device 16, inserting the screw 46 into the desired pegboard hole 20 and then twisting the screw in the appropriate directon of rotation for advancement. Continued rotation will securely affix the device to the pegboard by positive forces without deforming the hole. Rotation is completed with the opening between the arms in a vertical orientation. Thereafter, the hook 14 is coupled by passing the free end 32 through the hole 20 immediately above the attachment device 16, then turning the free end 32 upwardly so that the horizontal part 30 of the hook may rest on the bottom of the hole. With the central portion 38 of the hook held vertically beneath the upper portion 30 of the hook adjacent the opening 58 of the clip, the user will push the central portion 38 of the hook between the free ends 60 and 62 of the clip arms, spreading the opening 58 and inserting the hoop into the chamber of the clip. With the central portion 38 of the hook within the chamber 64 of the clip, the arms 54 and 56 of the clip will resile to their original orientation as shown in FIG. 7 with a snapping action holding the hook in secure position with respect to the pegboard. The orientation, as seen in FIGS. 2 and 3, will allow the hook to securely and reliably hold tools during operation and use. The orientation will also hold the clip to preclude the screw from rotation and becoming withdrawn or loosened with respect to the hole and pegboard.

The attachment device may be repositioned by a force exerted on the clip pulling it away from the pegboard while pivoting it upwardly about the upper portion. Such force will overcome the resilient force of the arms holding the clip in operational position. Such force will thereby separate the arms and allow the removal of the hook from both the clip and pegboard.

A conventional and standard pegboard 12 is about 9/64 inches thick with holes 20 about 5/32 inches in diameter for receiving hooks 14 at about 9/64 inches in diameter. Pegboard is normally held ¼ inches from the wall by conventional and standard spacers. With such pegboard, spacers and hooks, a screw of about X inches in length, 3/16 inches at its widest diameter and 9/64 threads per inch would function properly. Longer screws could be utilized if elongated spacers were employed to hold the pegboard a greater than normal distance from its supporting wall. The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and combination and arrangement of parts may be resorted to without departing from the spirit of the invention.

Now that the invention has been described,

What is claimed is:

1. An attachment device for use in combination with a pegboard and a hook, the pegboard being of a predetermined thickness with holes of a predetermined diameter extending therethrough and the hook having a lower portion outwardly bent away from the pegboard for supporting articles, an upper portion inwardly bent toward the pegboard for being positioned through a hole in the pegboard, and an elongated central portion coupling the upper and lower portions, the attachment device including:

a screw constituting the inboard end of the device and being fastenable within a hole in the pegboard, the size of the screw being correlated to the thickness of the pegboard and the diameter of the hole such that crests of the screw are of a diameter larger than the diameter of the hole an the roots of the screw are of a diameter smaller than the diameter of the hole and with the surfaces of the screw which join the crests and roots being axially spaced a distance so that, upon being twisted into the hole, the screw and the device may be positively held in operative position solely by forces exerted by the screw on the pegboard at the hole; and a clip constituting the outboard end of the device and coupled to the screw for being positively fastened to the pegboard by the screw, the clip being formed of a pair of symmetrically shaped, resilient support arms which together for a generally semicircular cross-sectional configuration in excess of 180 degrees with an opening between the arms on the side of the clip remote from the screw, the clip being of a size so that its opening will allow movement of the central portion of a hook therepast only upon the separating of the arms which thereby facilitates the receipt and releaseable retention of a hook by the resilient force of the arms so that the device may effect a permanent attachment of a hook to a pegboard until the hook is physically withdrawn from the clip by overcoming the resilient retention force of the arms retaining the hook. the device being of a reduced size so that when operatively positioned on the pegboard it will extend outwardly from its supporting hole in a radial direction to a distance less than half the distance to all next adjacent holes in the pegboard.

* * * * *